US005107647A

United States Patent [19]

Danielewicz

[11] Patent Number: 5,107,647

[45] Date of Patent: Apr. 28, 1992

[54] BEAM AND CONNECTOR BLOCK ASSEMBLY

[76] Inventor: Ben Danielewicz, 6031 Dalcastle Dr. N.W., Calgary, AB, Canada

[21] Appl. No.: 618,979

[22] Filed: Nov. 28, 1990

[51] Int. Cl.[5] ..... E04H 7/04

[52] U.S. Cl. ..... 52/235; 52/400; 52/468; 52/475; 52/775

[58] Field of Search ..... 52/235, 400, 464, 468, 52/656, 475, 772, 775

[56] References Cited

U.S. PATENT DOCUMENTS

| | | | |
|---|---|---|---|
| 3,380,210 | 4/1968 | Neal | 52/235 |
| 3,561,801 | 2/1971 | Chiu | 52/475 |
| 3,893,271 | 7/1975 | Kotlarz | 52/475 |
| 3,932,974 | 1/1976 | Wright | 52/235 |
| 4,648,231 | 3/1987 | Laroche | 52/775 |

FOREIGN PATENT DOCUMENTS

| | | | |
|---|---|---|---|
| 953070 | 8/1974 | Canada | 20/33.3 |
| 1066472 | 11/1979 | Canada | 20/29 |

*Primary Examiner*—David A. Scherbel
*Assistant Examiner*—Kien Nguyen
*Attorney, Agent, or Firm*—Anthony R. Lambert

[57] ABSTRACT

A framing system suitable for the assembly of thin panels such as glass or acrylic, which might be used in the construction of greenhouses, sun rooms, pool enclosures, wind screens or other non-insulating applications. The framing system consists of a unique three piece design which makes it particularly suitable for application to plastic materials such as ABS or PVC. The three piece design consists of an main supporting beam with a toothed slot to accept a correspondingly toothed extension of a T-shaped cover strip. The cover strip acts only to retain the supported panel against the beam. The beam supports the entire weight of the panelling. The beam is grooved along its edge in order to mate with a correspondingly shaped connector block. The connector block serves to connect adjacent beams.

18 Claims, 2 Drawing Sheets

BEAM AND CONNECTOR BLOCK ASSEMBLY

FIELD OF THE INVENTION

This invention relates to beam and connector block assemblies used in constructions using thin panels.

BACKGROUND OF THE INVENTION

A number of framing designs have already been proposed for the assembly of panels. Five of the most applicable designs are reviewed below.

U.S. Pat. No. 3,380,210 is intended for aluminum. To achieve sufficient deformation of the locking mechanism out of this material, the design uses two hooked tongs which lock onto toothed surfaces. The arrangement of the tongs is such that when the beam is used in a horizontal mode, any deformation of the beam increases the pressure on the tongs. This can make the cover plate more difficult to install and remove in this mode. In addition, this design would concentrate bending stress along a fairly narrow cross-section of the tongs, making the design prone to failure at their base. Furthermore, the fairly complex and thick cross-section of the cover plate makes it impossible to overlap the cover plates at beam junctions without first machining away some of the material.

U.S. Pat. No. 3,932,974 is a four component design which includes a toothed rubber T-shaped gasket which fits into a toothed metal slot. The rubber, being fairly soft, requires a fairly coarse tooth size. This make it difficult to achieve a snug fit with the panel to be held. To compensate for this the gasket does not fit into the beam directly. Instead, it fits into a third component, a metal rail which then fits into the main beam. The tension required to hold the panel against the rail is achieved by screws which, when tightened, draw the rail and gasket assembly into the beam. A fourth component, a cover plate, is required to hide the screw mechanism from view. The four part design is complex and its installation is expected to be fairly labour intensive.

U.S. Pat. No. 4,648,231 uses a three piece design: a structural beam, a cross shaped member with two tongs which fit into it, and a cap with another two tongs which fit into the cross shaped member. As noted above, the tonged designs, required for aluminum, have a number of disadvantages including susceptibility to failure and excessive thickness. When used in the horizontal position, downward slippage of the panels, such as could result from normal diurnal temperature changes, could eventually put the entire panel load on the locking teeth.

Canadian Patent #953,070 covers a design for the assembly of partitions. In this design, clips are fixed onto the partitions. A "synthetic resin" core is used to connect the clips together. By its design, the partitions need to be thick enough to hide the clip and resin core assembly, thus making it inapplicable for glass or other thin panels.

Canadian Patent #1,066,472 covers another design for the assembly of panels. The design also utilizes "keys or clips", attached to adjacent panels, as above, or "metallic sections" with a cover plate to hold thinner panels. Being primarily designed for aluminum however, the design is inappropriate for a more elastic material such as PVC or ABS plastic. Because of the lower elasticity of the metal, the design requires two tongs for adequate compliance in order to engage the cover plate adequately. The two tong design requires a greater beam and connector thickness and requires an additional glazing to cover the connector. A more important shortcoming however, is that when the beam is utilized in a horizontal mode to support a panel. the weight of the panel is transferred directly to the toothed extension of the connector. This creates a high bending stress at the point at which the toothed extension joins the main part of the beam, making it prone to failure, as well as making it difficult to replace damaged panels.

All of the prior art appears to concentrate on applications to extruded metal, primarily aluminum. As a result of the inherent strength of the materials, none of the earlier designs included connector blocks or other similar devices to reduce stress concentrations at junctions between beams.

SUMMARY OF THE INVENTION

The invention provides in one embodiment, a construction assembly for supporting thin panels, comprising in combination:

a beam having a first side wall, the first side wall including a pair of slot walls extending into the beam and defining a slot extending substantially along the length of the beam, the slot walls including a first gripping surface;

a cover strip having a pair of ridge walls projecting along one side of the cover strip and forming a projection along the length of the cover strip, the ridge walls including a second gripping surface; and the projection having complementary shape to the slot.

The slot walls may each include a first smooth portion and a first toothed portion, the first toothed portions being deeper in the slot than the first smooth portions and constituting the first gripping surface; and the ridge walls a second smooth portion and a second toothed portion, the second toothed portions being at the far end of the projection from the strip and constituting the second gripping surface.

The first side wall may include a lip projecting from the first side wall along the beam adjacent to the slot.

A second side wall may extend at an angle, in one embodiment a right angle, and in another an acute angle, from the first side wall, the second side wall having a recess extending along the length of the beam.

In one embodiment, the beam may be hollow and include at least first, second and third side walls defining a hollow interior and further including: a connector block having an exterior shaped to fit snugly within the hollow interior of the beam.

A plurality of such beams and connector blocks may be arranged about a central core.

BRIEF DESCRIPTION OF THE DRAWINGS

There will now be described a preferred embodiment of the invention, with reference to the drawings, by way of illustration, in which like numerals denote like elements and in which.

DESCRIPTION OF PREFERRED EMBODIMENTS

Physical Configuration

Figure 1:
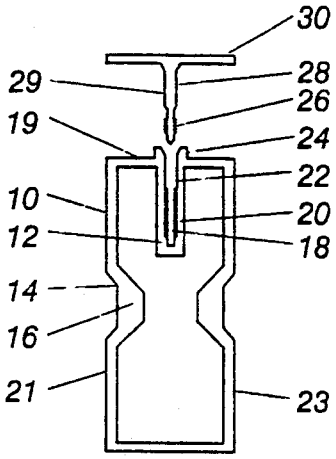
FIG. 1 illustrates a cross section of the simplest form of the beam and cover strip.

The features of the basic forms of beam and cover strip cross-sections are illustrated in FIG. 1. The beam 10 and strip 30 can be formed by extrusion to any practical length. The wall of the beam 10 is substantially rectangular in cross section. It contains an indentation 12 in order to accommodate a slot for the cover strip 30. Recesses 14 forming corresponding ridges on the inside of the beam are located along the adjacent walls in order to align attached connector blocks 40 (described in relation to FIGS. 2 and 2A). The wall of the beam 10 is thickened as shown at 16 below the surface of the recesses 14 to provide a better anchor mass for sheet metal type screws which would be used to attached the connector blocks 40 to the beam 10. A toothed slot 18 defined by slot walls 20 extending from a first side wall 19 of the beam 10 accommodates a correspondingly shaped toothed projection 26 defined by ridge walls 29 extending from the cover strip 30. The toothed portions or surfaces of the slot and projection define gripping surfaces. The walls 20 of the slot 18 should be designed to flex sufficiently to allow for the entry of the toothed projection 26 of the cover strip 30. A section of smooth wall 22 in the slot 18 accommodates a smooth section 28 on the cover strip 30. A raised lip 24 at the edge of the slot 18, provides an abutment for the panel to be held by the beam 10. When the beam 10 is used in a horizontal position, the lip 24 takes the weight of the panel above it and transfers it to the beam 10. The cover strip 30 has a toothed projection 26 which fits into the toothed slot 18. The lengths of the toothed and smooth portions may be selected according to the thickness of the panels expected to be used. One of the toothed portions of the projection and the slot may be shorter in extent (perpendicular to the plane of the first side wall) than the other toothed portion, and their relative sizes may be chosen depending on the variations of thickness of panel to be accommodated.

Tooth size is selected to enable pulling of the cover strip 30 away from the beam 10 only by beginning at one end of the beam 10. This allows for easy replacement of damaged panels.

If required, a pin (not shown) could be fitted on the inside of the structure, at each end of the beam and passing through both the beam and cover strip. This would lock the ends of the cover strip 30 into the beam 10 to prevent removal of the strip 30 from the outside. A smooth face 28 on the cover cap matches the smooth section 22 on the slot. It allows the cover cap to lock in at any of a range of depths within the slot, thus accommodating a corresponding range in panel thicknesses. In addition, when the beam is used in a horizontal position, the gravitational load of the panel is transferred through the raised lip 24, to the smooth wall of the slot 22, to the smooth section of the cover cap 28, to the opposite smooth wall of the slot and finally into the beam wall. This reduces stress concentrations within the beam 10 and the toothed surfaces 20 and 26 and allows the design to function well under a wide range of loads.

Thus, the beam 10 is hollow and includes at least first side wall 19, second side wall 21 and third side wall 23 defining a hollow interior. While a rectangular cross section of a beam is shown in FIG. 1, the beam could conceivably be more or less trapezoidal for specialized applications shown in FIG. 5.

Figure 2:
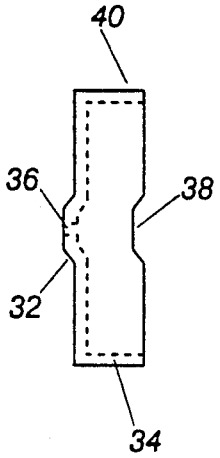
FIGS. 2 and 2A are side and end views respectively of the connector block which would join beams at right angles to each other.
Figure 2A:
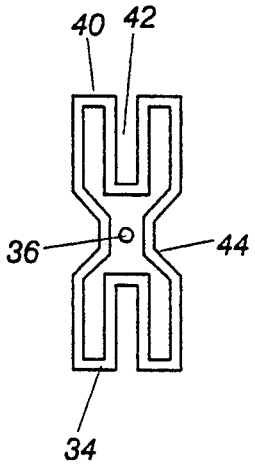

FIGS. 2 and 2A illustrate the most important features of a connector block 40 for joining beams such as a plurality of beams 10 to each other. The connector block 40 is shaped somewhat like a "rectangular bowl" with indentations along its walls which accommodate the internal shape of the beam 10.

FIG. 2 illustrates a side view of the "bowl" shape of the connector block 40. This profile shows a protrusion 32 which fits into and matches the indentation 14 on the supporting beam 10. The wall 34 of the "bowl" is at right angles to its base in order to allow the connecting beam 10 to slip over it. A hole 36 in the centre of the base of the "bowl" shape takes a sheet metal type screw which attaches the connector block 40 to the supporting beam 10 at its indentation 14. The connection between the connector block 40 and its supporting beam can also be strengthened with the application of an appropriate adhesive (which are well known in the art). The indentation 38 on the lip of the bowl is simply to reduce space when blocks are stacked together in storage by accommodating its neighbour's protrusion 32.

FIG. 2A illustrates a top view of the "bowl" shape of the connector block. This profile shows that the shape of the outer surface of the connector block 40 is defined by the interior form of the beam 10 illustrated in FIG. 1. The connector block 40 is fitted with an indentation 42 to accommodate the beam slot structure 12. A second identical indentation is located at the opposite end of the block in order to simplify block placement during installation (since either end can be used). A second set of indentations 44, on the adjacent walls of the connector, accommodate the protrusions 16 of the beam. The connector block 40 has an exterior shaped to fit snugly within the hollow interior of the beam.

Figure 3:
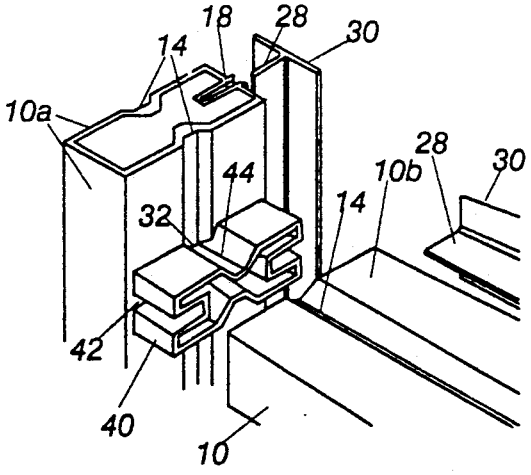
FIG. 3 is an exploded view of a beam with a connector block attached.

FIG. 3 illustrates an exploded view of a connector block 40 with two beams **10*a* and 10*b* and their respective cover strips 30. The second beam 10*b* is shown in the position in which it would fit over the connector block 40 to form a right angle junction. Two cover strips 30 are also shown in the positions in which they would fit into their respective beams 10*a* and 10*b*. The connector block 40 is shown attached to the vertical beam 10*a*. Its alignment on the beam 10*a* is established by the respective surfaces of the beam 10*a* and block 40 as illustrated in FIGS. 1 and 2. After the beams 10*a* and 10*b* are assembled, a panel would be placed against them and the horizontal cover strips 30 would hold it in place. The ends of the horizontal cover strips 30 would subsequently be covered by the vertical cover strips 30**, leaving a pleasing appearance to the junction.

Figure 4:
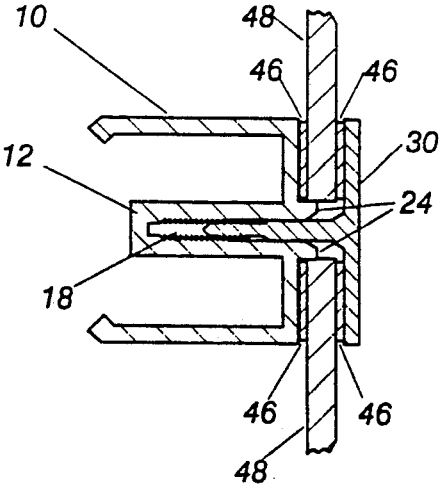
FIG. 4 illustrates a cross section of an assembled wall section with panels held in place by the cover strip.

FIG. 4 illustrates a detailed portion of a cross section of a beam and cover strip assembly connecting two adjacent panels. In this view, the surfaces of the beam and cover strip which hold the panel in place are covered with an adhesive weather stripping 46. This serves to waterproof the connection and to provide a more even stress distribution for the panel 48. It is clear from this illustration, that a range of panel widths can be accommodated by this design, simply by a deeper or shallower insertion of the cover strip 30 into the beam slot 12.

Figure 5:
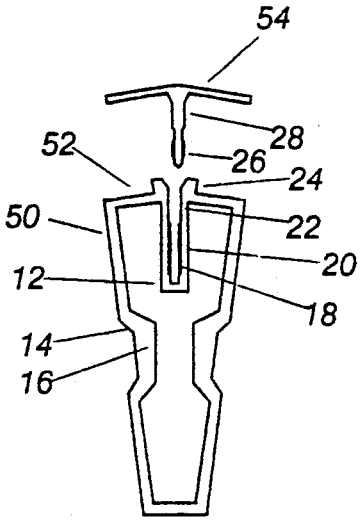
FIG. 5 illustrates a variation on the beam design which allows the connection of panels that are not colinear.

FIG. 5 shows a variation on the rectangular cross section beam 10 described in FIGS. 1, 3 and 4. In this variation, the larger surfaces of the beam 50 have been positioned at an angle of 15 degrees relative to each other. The faces 52 of the beam 50 in contact with the panels have also been rearranged to this angle. The cover strip 54 has been correspondingly modified. The other features of the beam 50 function in like manner to the equivalent features of beam 10.

When used in conjunction with straight panels, a series of beams 50 of this variation form a curved structural wall. A series of six beams 50 of the variation illustrated in this figure would be required to complete a 90 degree curve. To construct an arched structure, beams 50 of this variation would be used horizontally. In this application, they would be used in conjunction with conventional rectangular beams placed vertically. To construct a curved wall, the beam variation would be used vertically, in conjunction with rectangular cross section beams, placed horizontally. Clearly, this beam variation could be modified to other angles, according to other requirements for non-linear junctions.

Figure 6:
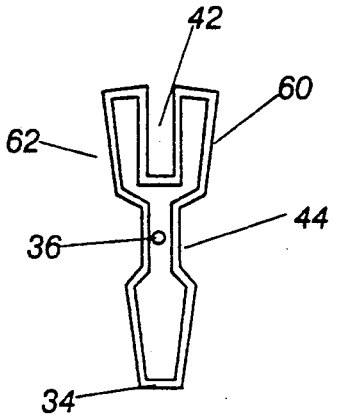
FIG. 6 illustrates a variation on the connector block which would join the beam variation in FIG. 5 to another beam.

FIG. 6 illustrates the variation of the connector block shown in FIG. 2A, which would join the beam variation illustrated in FIG. 5 to a second beam. The side face 62 of this block 60 has a profile which is identical to the side view of the block shown in FIG. 2. This would allow this beam variation to connect to a second beam of the same type or to a different variation such as that illustrated in FIG. 1, depending on the requirements of the design of the structure. The other features of the block 60 function in like manner to the equivalent features shown in block 40.

Figure 7:
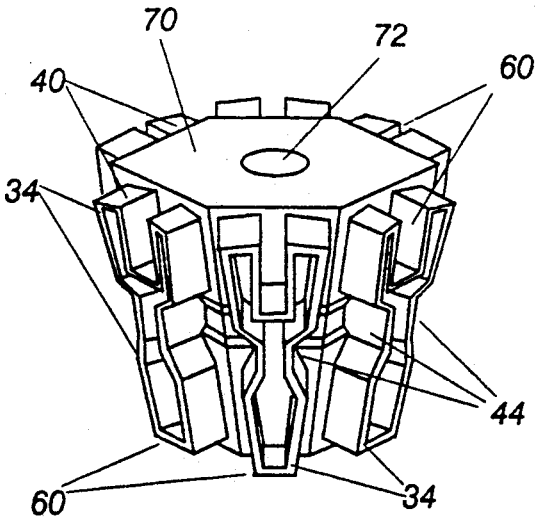
FIG. 7 illustrates a series of connector blocks, such as those in FIG. 6, attached to a hexagonal core.

FIG. 7 illustrates an assembly of connector blocks, such as those illustrated in FIG. 6. The connector blocks 60 in this figure are shown attached around a central hexagonal core 70 with a hole 72 through its vertical axis. The connector projections or blocks 60 could be individually attached to the core, or the entire assembly could be cast as a unit. The connector block assembly would be made of the same material as the beam and connector cap. The purpose of the connector block assembly is to create a junction for six converging beams, such as those illustrated in cross section in FIG. 5. A series of such junctions and beams could be utilized to construct a geodesic dome or a portion of one. The spaces formed by the beams would accommodate flat triangular panels to complete the structure.

Figure 8:
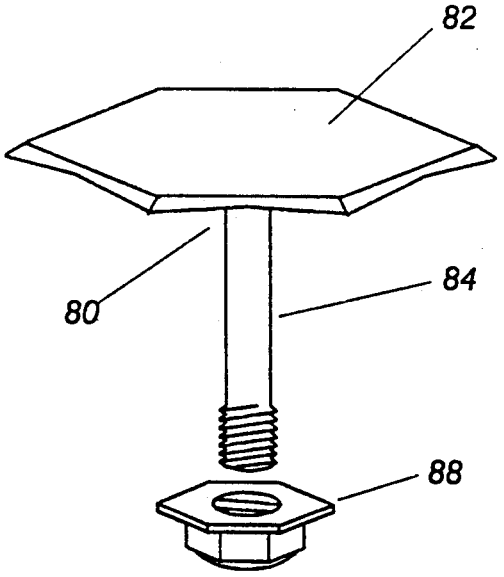
FIG. 8 illustrates a cover plate assembly to cover the junction of beams at a connector block such as that illustrated in FIG. 7.

FIG. 8 illustrates a cover plate assembly 80 to cover the ends of the cover strips for each of the six beams meeting a junction such as that illustrated in FIG. 7. The cover plate assembly consists of a hexagonal plate 82 with a central extension 84 that fits through the central hole 72 in the connector block assembly and is held against it by a threaded bolt fastener 88 or an equivalent device.

A person skilled in the art could make immaterial modifications to the invention described and claimed in this patent without departing from the essence of the invention.

I claim:

1. A construction assembly for supporting a thin panel, comprising in combination:

a beam having a first side wall, the first side wall including a pair of slot walls extending into the beam and defining a slot extending substantially along the length of the beam, the slot walls each including a first smooth face and a first gripping surface interior of the first smooth face;

a cover strip having a pair of ridge walls projecting along one side of the cover strip and forming a projection along the length of the cover strip, the ridge walls each including a second smooth face and a second gripping surface interior of the second smooth face;

the slot walls being sufficiently flexible in relation to the ridge walls that the slot walls flex upon entry of the cover strip projection into the slot;

the first side wall including at least a lip projecting from the first side wall along the beam adjacent to the slot whereby the weight of the panel in use is transferred across the first and second smooth faces; and the projection having complementary shape to the slot.

2. The construction assembly of claim 1 in which:

the slot walls each include a first smooth portion and a first toothed portion, the first toothed portion being deeper in the slot than the first smooth portions and constituting the first gripping surface; and the ridge walls each include a second smooth portion and a second toothed portion, the second toothed portions being at the far end of the projection from the strip and constituting the second gripping surface.

3. The construction assembly of claim 2 in which the beam includes at least one second side wall extending at an angle from the first side wall, the second side wall having a recess extending along the length of the beam.

4. The construction assembly of claim 3 in which the second side wall extends at a right angle to the first side wall.

5. The construction assembly of claim 3 in which the second side wall extends at an angle less than 90° to the first side wall.

6. The construction assembly of claim 3 in which the beam is hollow and includes at least first, second and third side walls defining a hollow interior and further including:

a connector block having an exterior shaped to fit snugly within the hollow interior of the beam; and a protrusion on one side of the connector block that is complementary to the recess extending along the length of the beam.

7. The construction assembly of claim 6 in which the connector block is hollow and closed at one end.

8. The construction assembly of claim 3 in which the second side wall is thickened at the recess.

9. The construction assembly of claim 2 further including weather-stripping disposed between the cover strip and the beam.

10. A construction assembly for supporting thin panels comprising:

a plurality of beams and corresponding cover strips;

a connector block having a plurality of connector projections disposed around the connector block;

each beam being hollow and having an interior defined by at least first, second and third side walls, the first side wall including a pair of slot walls extending into the beam and defining a slot extending substantially along the length of the beam, the slot walls each including a first smooth face and a first gripping surface interior of the first smooth face;

each cover strip having a pair of ridge walls projecting along one side of the cover strip and forming a projection along the length of the cover strip, the ridge walls each including a second smooth face and a second gripping surface interior of the second smooth face, the projection having complementary shape to the slot;

the slot walls of each beam being sufficiently flexible in relation to the ridge walls of the corresponding cover strip that the slot walls flex upon entry of the cover strip projection into the slot;

the first side walls each including a lip projecting from the first side wall along the beam adjacent to the slot whereby the weight of the thin panels in use is transferred across the first and second smooth faces; and each connector projection having an exterior shaped to fit snugly within the hollow interior of the beam.

11. The construction assembly of claim 10 in which:

the slot walls each include a first smooth portion and a first toothed portion, the first toothed portions being deeper in the slot than the first smooth portions and constituting the first gripping surface; and the ridge walls each include a second smooth portion and a second toothed portion, the second toothed portions being at the far end of the projection from the strip and constituting the second gripping surface.

12. The construction assembly of claim 11 in which each beam includes at least one second side wall adjacent to and extending at an angle from the first side wall, the second side wall having a recess extending along the length of the beam and each connector block including a protrusion on one side of the connector block that is complementary to the recess extending along the length of the beam.

13. The construction assembly of claim 12 in which each second side wall extends at a right angle to the adjacent first side wall.

14. The construction assembly of claim 12 in which each second side wall extends at an angle less than 90° to the first side wall.

15. The construction assembly of claim 12 in which each second side wall is thickened at its recess.

16. The construction assembly of claim 12 further including weather-stripping disposed between each cover strip and the corresponding beam.

17. The construction assembly of claim 10 in which the number of connector projections disposed around the connector block is 6.

18. A connector block for a construction assembly for supporting a thin panel, in which the construction assembly comprises in combination a hollow beam having an interior defined by at least a first side wall, a second side wall and a third side wall, the first side wall including a pair of slot walls extending into the beam and defining a slot extending substantially along the length of the beam, the slot walls each including a second smooth face and a first gripping surface interior of the first smooth face; a cover strip having a pair of ridge walls projecting along one side of the cover strip and forming a projection along the length of the cover strip, the ridge walls including a second gripping surface; the slot walls being sufficiently flexible in relation to the ridge walls that the slot walls flex upon entry of the cover strip projection into the slot; the first side walls each including a lip projecting from the first side wall along the beam adjacent to the slot; the projection having complementary shape to the slot whereby the weight of the thin panel in use is transferred across the first and second smooth faces, the connector block comprising:

a connector block having an exterior shaped to fit snugly within the hollow interior of the beam.

* * * * *